US005888016A

United States Patent [19]

Ahn

[11] Patent Number: 5,888,016

[45] Date of Patent: Mar. 30, 1999

[54] SELF-RECOVERING TRAFFIC COLLAR CONE

[76] Inventor: Eui Sig Ahn, Bokgee Apt. 1-402, Kweian-Dong, Sosa-Gu, Buchun-Si, Kyungki-Do, Rep. of Korea

[21] Appl. No.: 783,757

[22] Filed: Jan. 15, 1997

[30] Foreign Application Priority Data

Apr. 20, 1996 [KR] Rep. of Korea ..... 1996/12095

[51] Int. Cl.[6] ..... E01F 9/012

[52] U.S. Cl. ..... 404/10; 116/63 C; 40/612

[58] Field of Search ..... 116/63 P, 63 C; 404/9, 10, 11, 13, 14, 16; 40/607, 608

[56] References Cited

U.S. PATENT DOCUMENTS

| | | | |
|---|---|---|---|
| 2,942,571 | 6/1960 | White | 116/63 C |
| 3,132,624 | 5/1964 | Shoemaker, Jr. | 116/63 C |
| 4,197,808 | 4/1980 | Kinninger | 116/63 C |
| 4,611,949 | 9/1986 | Schmanski . | |
| 4,806,046 | 2/1989 | Clark . | |
| 5,199,814 | 4/1993 | Clark et al. . | |
| 5,205,236 | 4/1993 | Hughes | 404/13 X |
| 5,305,538 | 4/1994 | Kanzelberger | 40/616 |
| 5,515,807 | 5/1996 | Speer et al. | 404/16 X |
| 5,587,699 | 12/1996 | Faloon et al. | 340/475 |

FOREIGN PATENT DOCUMENTS

| | | | |
|---|---|---|---|
| 6-108425 | 4/1994 | Japan | 404/9 |
| 6-248618 | 9/1994 | Japan | 404/9 |
| WO 94/29527 | 12/1994 | WIPO | 404/9 |

*Primary Examiner*—James Lisehora
*Attorney, Agent, or Firm*—Pillsbury, Madison & Sutro LLP

[57] ABSTRACT

A traffic collar cone has a delineator having a reflection sheet attached on its upper part. A plug is placed under the sheet having an air inlet and outlet extending upwardly and downwardly therethrough. A conical body member is provided, having in its upper end wall an insertion hole in which the plug is mounted. A support panel is provided at the bottom of the body and cone collars are attached on the outer surface of the body member, with vertical spacing between them. The traffic collar cone is made of flexible material and designed to recover its original shape after being impacted, so that injury to collar cone is eliminated or minimized. The support panel can be adhered onto a roadway.

3 Claims, 3 Drawing Sheets

SELF-RECOVERING TRAFFIC COLLAR CONE

BACKGROUND OF THE INVENTION

This invention relates to the traffic collar cone, in particular, to the self-recovering traffic collar cone that is more effective for drawing the driver's attention and thus can guarantee the safety of driving, and that is so built as to be able to get crushed when impacted and to recover its original shape after lapse of impact so that its product life span can be fully extended and the vehicle collided therewith is also kept substantially unharmed.

Generally, the traffic collar cone has been used as the indicator to let the driver recognize the changing state of traffic lane more accurately, especially at the place where the road becomes narrow in case of the road repair work or is curved.

However, the conventional traffic cone is normally made of the non-recovery materials such as rubber, polyethylene, vinyl chloride resin or the like and the reflection sheet is attached thereon so that upon the even small impacts, the collar cone or the vehicles are easily damaged. As the result of it, replacement of the traffic collar cone is frequently required and therefrom the economic loss is greatly happened.

SUMMARY OF THE INVENTION

This invention is designed to overcome the above-noted problems the conventional collar cone has.

Accordingly, one object of this invention is to provide the traffic collar cone made of materials having the great flexibility so as to recover its original shape after lapse of impact, by which the traffic collar cone is able to be kept unharmed even when collided with by a vehicle.

Another object of this invention is to provide the traffic collar cone coated with the anti-dust silicon to keep its reflection effects as it was for the long time.

Still another object of this invention is to provide the traffic collar cone with which the vehicle collided is also kept substantially unharmed.

A further object of this invention is to provide a traffic collar cone designed to draw the driver's attention as much as possible and thus guarantee safe driving.

BRIEF DESCRIPTION OF THE INVENTION

DETAILED DESCRIPTION OF PREFERRED EMBODIMENTS OF THE INVENTION

In order to attain the above-noted goals, a traffic collar cone is provided which has two portions, that is, a delineator in which a reflection sheet is attached on its upper part and a plug is placed under the sheet, having air inlet and outlet passed through upwardly and downwardly, and a body member in the form of cone in which the insertion hole is provided for receiving the plug, for causing the plug to be mounted at the upper end of the body member. A support panel is placed at the bottom end of the body member, and the collar cone is attached on the outer surface of the body member.

As built above, this collar cone has many advantages, and a more detailed description is provided below with reference to the accompanying drawings.

Figure 2:
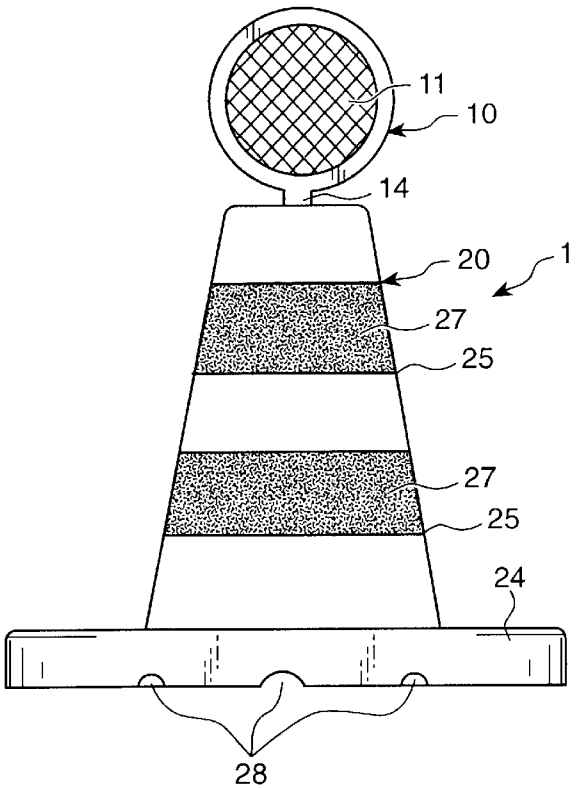
FIG. 2 is a front view of the self-recovering traffic collar cone of this invention.
Figure 1:
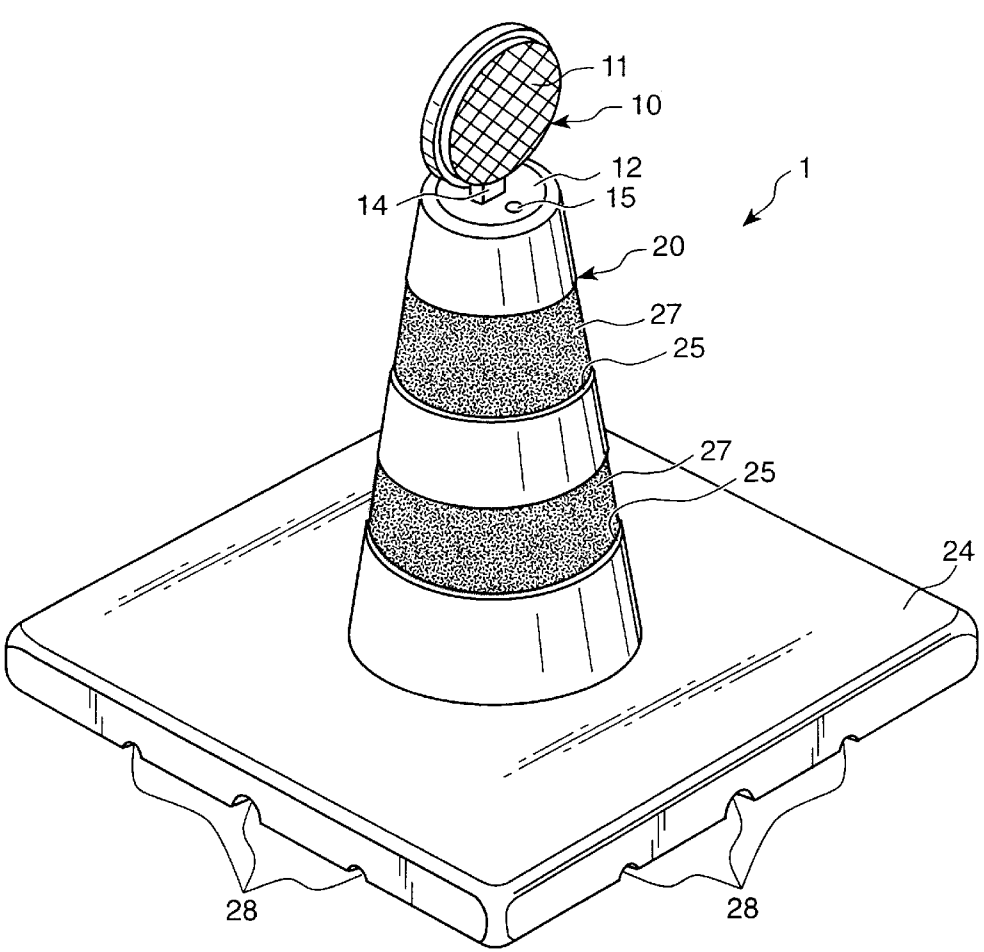
FIG. 1 is a perspective view of the self-recovering traffic collar cone of this invention.
Figure 4:
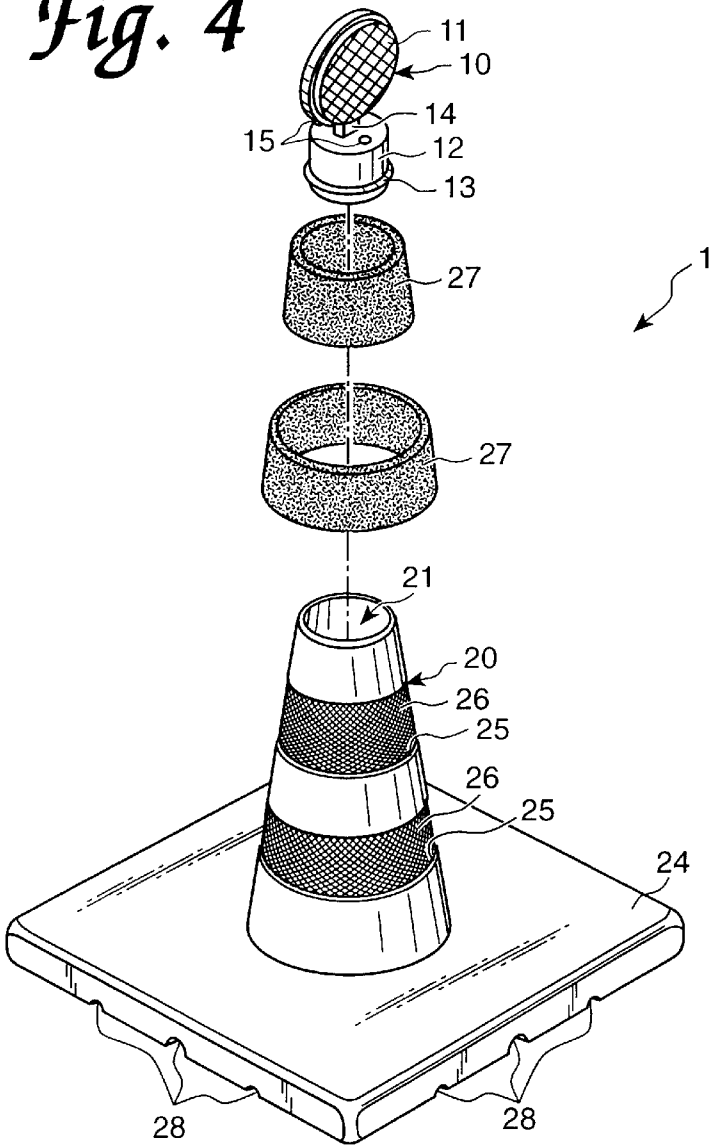
FIG. 4 is an exploded perspective view of the self-recovering traffic collar cone.
Figure 3:
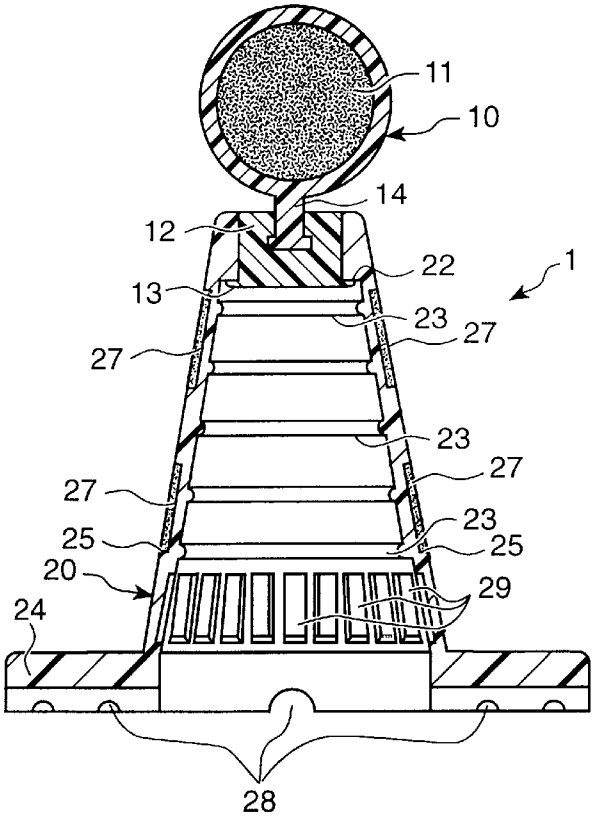
FIG. 3 is a vertical section view of the self-recovering traffic collar cone of this invention.
Figure 5:
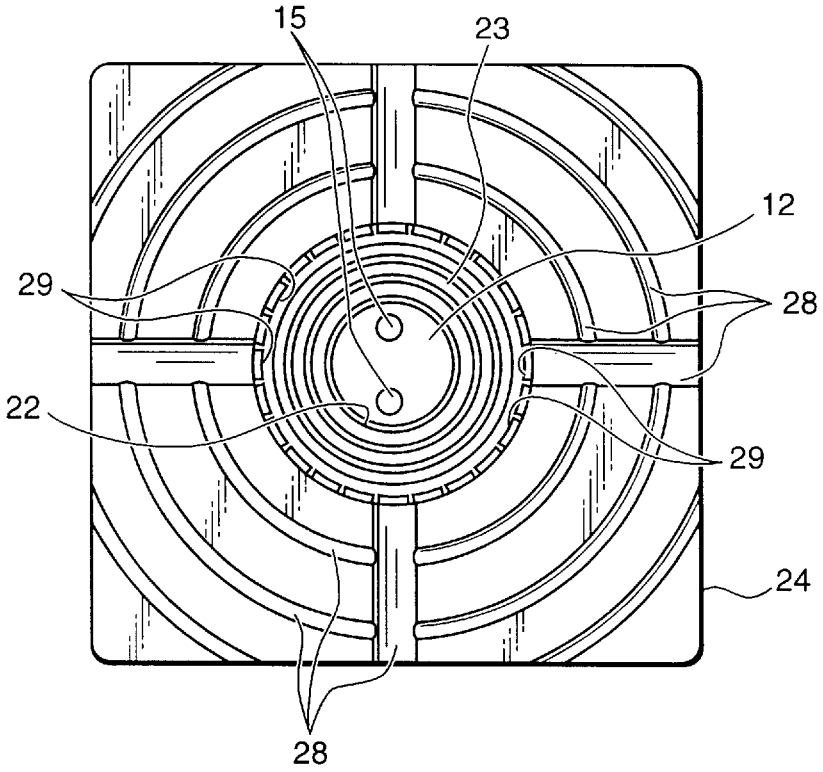
FIG. 5 is a bottom view of the self-recovering traffic collar cone.
Figure 6:
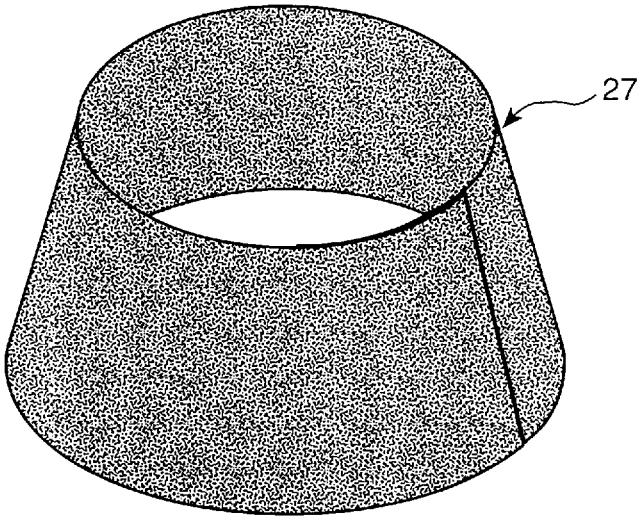
FIG. 6 is a perspective view of the cone collar being attached on the self-recovering traffic collar cone.

As shown in FIG. 1 and FIG. 6, delineator(10) has a reflection sheet(11) attached at its upper part and a supporter (14) placed underneath sheet(11) for supporting the reflection sheet(11) and the plug(12) that upholds the lower part of said reflection sheet(11) and are on the other hand mounted on the support panel, and that is provided with a circular protrusion(13) on its lower trim.

The plug(12) has the several vertical air outlets and inlets(15)

The body member(20) has an insertion hole(21) in its upper end for the plug(12) to be mounted, and a stub at its lower end for engaging with the circular protrusion(13). On the inner surface of the cone-shaped collar cone body member(20), multiple circular ribs(23) are projected inwardly The support panel(24) is placed at the bottom end of the collar cone body member(20); the support panel(24) has many pressurized air outlet grooves(28) provided therein, extending in a radial direction and in concentric circles.

Further, on the outer surface of the body member(20) are provided multiple grooves(25) that are of irregular surface (26) engraved so as to have the opposite angles, on which cone collars(27) are attached.

The inner surface of the collar cone body member(20) has flexible grooves(29) at its lower end.

Any of collar cone body member(20) and the delineator (10) are coated with diluted silicon mixed with tin origin organic materials.

It is advisable to use polyurethane having superior flexibility for making the collar cone body member(20) and plug(12) of the delineator(10).

The operation and the advantage of the traffic collar cone this invention are as follows.

Once the traffic collar cone installed on the road is collided with by a vehicle or the traffic collar cone(1) is trod on by a vehicle, the body member(20) is bent or is squeezed due to elastic power of the flexible grooves(29), simultaneously the inner air present within the cone is forced out through the air outlet and inlet(15) so that the both collar cone(1) and vehicle collided therewith are kept unharmed. Further, after the vehicle departs from the place, the traffic collar cone(1) recovers its original shape based on its self-recovery power.

That is, when traffic collar cone collided with by a vehicle, the body member of collar cone gradually recovers its original shape, based on the self-recovery power of the multiple flexible grooves(29) and the circular rib(23) formed on the inner surface of the collar cone body member(20), simultaneously with air entering into inside of the body member(20) through the air inlet and outlet(15), so that irrespective of the collision occurrence with a vehicle the collar cone can be reshaped as it was, and thereby it can be used for a long time.

Further, the upper part of the outer surface of the body member(20) is provided with several irregularly surfaced grooves(25) and therein are inserted, insert the cone collars from above of the body member. Each cone collar has both ends of a respective reflection sheet(11) adhered each other by way of a high frequency adhesion method to provide a frusto-conically tapered structure.

In this construction, the irregular surface of the body member(20) not only broadens the collar adhesive area to the body member(20) but also allows the bubbles produced from the adhesive material to go out; thereby a strong adhesion is obtained and accordingly adhesion work can be easily performed.

On the other hand, for installing the traffic cone collar cone(1) on the road, the plug(12) in the delineator(10) is previously inserted in the insertion hole(21) formed in the upper end of the body member(20).

At that time, it is required for the protrusion(13) formed on the bottom trim of plug(12) to be fully engaged against in the downwardly facing lower shoulder(22) provided in the upper end of the body member (20), and which surrounds the insertion hole(21).

After the delineator(10) has been assembled painting of adhesive materials on the ground is done and then the support panel(24) of the body member (20) is adhered on the ground (i.e. on the roadway).

At that time, since bubbles from the adhesive are exhausted through the pressurized air outlet(28) so that collar cone body member(20) is strongly adhered on the ground.

Any of all the components such as the delineator(10), collar cone body member(20) and reflection sheet(11) are coated with coating materials to prevent dust, or pollution and oil from adhering to it and further to protect against change of colour from ocurring due to ultraviolet radiation. Accordingly even though it is installed outside, its reflection effect is continued as it was and its product life span is fully extended.

As shown in above, this invention's traffic collar cone is made of flexible material and designed to be recover its previous shape as it was after lapse of impact so that it is possible to eliminate the injury to the collar cone even after being collided with by a vehicle and guarantee its use for, a maximum long time, and enhance the work efficiency; thereby high productivity and economic efficiency can be obtained.

I claim:

1. A self-recovering traffic collar cone, comprising:

an upright, upwardly tapering frusto-conical body member having a plurality of vertically spaced circumferential grooves externally provided therein;

a plurality of upwardly tapering frusto-conical cone collars each having an externally presented reflective surface, and each being received a respective one of said grooves and attached to said body member;

a support panel provided on said body member at a lower end of said body member and having a downwardly facing lower surface arranged to support said traffic collar cone on a roadway;

said lower surface having a pattern of intersecting radial and concentric circular grooves provided therein and arranged for permitting emergence of air therethrough from within said traffic collar cone upon collision of a vehicle with the traffic collar cone;

said body member having an upper end wall having an opening provided vertically therethrough, so as to provide a downwardly facing annular shoulder within the body member surrounding a lower end of said opening;

a delineator having an outwardly facing sheet of reflective material provided thereon, and having a downwardly projecting protrusion;

a plug having an outer parametrical flange; said plug being installed in said opening in said upper end wall of said body member, such that said flange engages said shoulder from below, and an upper end of said plug is upwardly exposed through said opening;

said downwardly projecting protrusion of said delineator being mounted to said plug so as to extend upwards from said upper end of said plug;

said body member being made of shape-recovering flexible material;

said plug having at least one air inlet and outlet hole formed vertically therethrough for permitting exiting and entering of air as the traffic collar cone is impacted by a vehicle and then recovers from being so impacted.

2. The traffic collar cone of claim 1, wherein:

said body member on a readially inner surface thereof, is provided with a plurality of vertically spaced circumferentially extending ribs at which said body member is relatively thicker than is said body member between said ribs.

3. The traffic collar cone of claim 1, wherein:

said traffic collar cone bears an external coating of a material serving to reduce adherence of dust and to limit discoloration due to ultraviolet radiation.

* * * * *